US005279899A

United States Patent [19]

Asrar

[11] Patent Number: 5,279,899

[45] Date of Patent: Jan. 18, 1994

[54] SULFONATED POLYAMIDES

[75] Inventor: Jawed Asrar, Chesterfield, Mo.

[73] Assignee: Monsanto Company, St. Louis, Mo.

[21] Appl. No.: 852,464

[22] Filed: Mar. 17, 1992

[51] Int. Cl.[5] ..... B32B 15/08; B05D 3/10

[52] U.S. Cl. ..... 428/458; 427/304; 427/306; 428/474.4; 428/475.5; 528/337

[58] Field of Search ..... 428/252, 137, 458, 474.4, 428/475.5; 427/304, 306; 156/656; 528/337; 205/168

[56] References Cited

U.S. PATENT DOCUMENTS

| | | | |
|---|---|---|---|
| 3,560,257 | 2/1971 | Schneble, Jr. et al. | 428/137 |
| 3,561,995 | 2/1971 | Wu et al. | 427/304 |
| 3,996,202 | 2/1976 | Keil | 528/337 |
| 4,006,047 | 2/1977 | Brummett et al. | 156/656 |
| 4,493,861 | 1/1985 | Sirinyan et al. | 427/304 |
| 4,552,626 | 11/1985 | Stevenson | 205/168 |
| 4,554,183 | 11/1985 | Sirinyan et al. | 427/306 |
| 4,568,571 | 2/1986 | Sirinyan et al. | 427/306 |
| 4,614,684 | 9/1986 | Ebneth et al. | 428/252 |
| 4,820,553 | 4/1989 | Sopchak et al. | 427/304 |

FOREIGN PATENT DOCUMENTS

| | | |
|---|---|---|
| 47-043160 | 10/1972 | Japan . |
| 49-017676 | 5/1974 | Japan . |
| 56-161432 | 12/1981 | Japan . |
| 57-100141 | 6/1982 | Japan . |
| 57-158236 | 9/1982 | Japan . |
| 60-155681 | 8/1985 | Japan . |
| 62-170483 | 7/1987 | Japan . |
| 62-243628 | 10/1987 | Japan . |
| 63-270489 | 11/1988 | Japan . |
| 3-120043 | 5/1991 | Japan . |

OTHER PUBLICATIONS

Derwent Publications Ltd.—Mitsubishi Rayon Co. Ltd., MITS, Dec. 30, 1970.

Derwent Publications Ltd.—Asahi Chemical Ind. K.K., ASAH, Apr. 17, 1986.

*Primary Examiner*—Thomas J. Herbert, Jr.

*Attorney, Agent, or Firm*—Thomas E. Kelley; Mark F. Wachter

[57] ABSTRACT

Sulfonated polyamides, e.g. aliphatic polyamides such nylon-6 and nylon-6,6, partially aromatic polyamides and polyaramides such as poly(phenyldiamidoterephthalate), provided with sulfonate radicals chemically bonded as amine pendant groups to nitrogen atoms in the polymer backbone are useful for stainblocking polyamide textile articles and as precursors for providing electrolessly-deposited metal-coatings on palladium sulfonate modified surfaces. Nickel-coated polyaramide textile material have surprisingly exceptional flame resistance.

13 Claims, No Drawings

SULFONATED POLYAMIDES

Disclosed herein are sulfonated polyamides, polyamide articles surface modified with sulfonate groups including stain-resistant polyamide textile articles, metal-coated polyamide articles having sulfonate groups between said metal and the polyamide surface, and methods of making and using such polyamides and articles.

BACKGROUND OF THE INVENTION

Polyamide textile materials, e.g. nylon carpets, are provided with stain blocking properties by application of coating comprising a sulfonated compound which, because it is not chemically bonded to the fiber, can be removed, with extensive washings. One object of this invention is to provide polyamide textile materials with enhanced stainblocking properties having sulfonate groups chemically attached to the nitrogen in the polymer backbone. Another object of this invention is to provide sulfonated polyamides as thin surface coatings on polyamide substrates or a bulk solutions of sulfonated polyamide for preparing films or coatings. Another object of this invention is to provide sulfonated polyamide coatings with noble metal counterions for use as catalytic surfaces for electroless deposition of metal. These and other objects will be more readily apparent from the following description of the invention and illustrative examples.

SUMMARY OF THE INVENTION

One aspect of this invention provides sulfonated polyamides including sulfonated aliphatic polyamides such as nylon-6, nylon-6,6, nylon-11 or nylon-12, sulfonated partially aromatic polyamides and sulfonated polyaramides; an especially preferred sulfonated polyaramide is benzylsulfonated polyaramide. Preferred sulfonated polyamides comprise benzylsulfonate or propylsulfonate groups attached to the amide groups of the polymers. The degree of sulfonation can range from low levels, e.g. about 1 percent or less, of the amide groups when sulfonation is limited to the surface of a polyamide article to high levels e.g. more than 20 percent up to about 100 percent, of the amide groups when sulfonation is effected throughout he bulk of the polyamide material.

When sulfonation is limited to the surface of a polyamide article, another aspect of this invention provides polyamide articles having a high density of sulfonate groups at the surface, e.g. more than 10 percent, say at least 20 percent or more, often about 50 percent, of sulfonated amide groups at the surface, where substantially all of the sulfonate groups are within 50 nanometers of the surface, preferably within 10 nanometers of the surface.

Another aspect of this invention provides polyamide articles having strongly adherent metal coatings where chemically bonded sulfonate groups provide anion sites for noble metal counterions which can catalyze the electroless deposition of metals such as copper or nickel. Preferred metal coatings are nickel which provides polyaramides textile materials having flame retardance substantially as good as the flame retardance of uncoated polyaramide materials.

This invention also provides methods of chemically bonding sulfonate compounds as subtituents to the amide linkage group in the backbone of such polyamides. In this method amide hydrogens of a polyamide are deprotonated, e.g. in a solution of sodium hydride or t-butoxide salt in dimethylsulfoxide (DMSO), to provide the amide groups with anionic nitrogen which can be sulfonated by reaction with a sulfonating compound such as a salt of 4-bromobenzyl-sulfonic acid or 1,3-propylsultone.

DETAILED DESCRIPTION OF PREFERRED EMBODIMENTS

As used herein the term "textile material" means fiber, yarn, tow, sliver, woven fabric, knitted fabric, non-woven fabric and the like.

The polyamides useful in this invention can be derived from caprolactam or from the condensation reaction of a diamine and dicarboxylic acid, e.g. diamines selected from the group consisting of hexamethylene diamine and phenylene diamine and at least one acid selected from the group consisting of terephthalic acid, isophthalic acid and adipic acid. Aliphatic polyamides can be selected from the group consisting of nylon-6, nylon-6,6, nylon-11 and nylon 12. Partially aromatic polyamide can comprise hexamethylenediamido adipate-isophthalate units. Aromatic polyamides, commonly called polyaramide, are commercially available from E.I. duPont de Nemours and Company (DuPont) as Kevlar TM polyaramide comprising phenyldiamido terephthalate units and Nomex TM polyaramide comprising phenyldiamido isophthalate units. Polyamide articles can comprise molded articles of engineering thermoplastic such as nylon-6 or nylon-6,6 or textile materials of an aliphatic polyamide or a polyaramide.

Depending on the advantages sought to be achieved for an application, sulfonated polyamides can be prepared in solutions or as surface coatings or modifications of polyamide articles. Regardless of the form of the polyamide, the first step in the method of this invention is to deprotonate the amide groups in the polymer backbone, providing anionic nitrogen atoms. This is conveniently effected using a solution of sodium hydride or a t-butoxide salt, e.g. preferably of a monovalent metal such as potassium, in a solvent capable of dissolving or at least swelling polyamide. Useful solvents include DMSO, dimethyl formamide, dimethyl acetamide and N-methyl-2-pyrro-lidinone. A preferred solvent for many applications involving polyaramides is DMSO. The anionic nitrogen atoms of the deprotonated polyamide can be reacted with a sulfonating compound such as a salt of 4-bromobenzylsulfonic acid or 1,3-propylsultone in a convenient solvent, e.g. DMSO. Contacting the deprotonated amide groups with such a sulfonating agent provides sulfonated groups substituted on the amide linkage groups of the polyamides, i.e. sulfonated polyamides.

The extent of sulfonation can be controlled by routine experimentation with reaction time and conditions, e.g. concentrations, temperature and the like. For instance rapid contact with low concentrated solutions, e.g. less than 5 second immersions in solutions of about 1 percent by weight of deprotonating agent and sulfonating agent at moderate temperature, e.g. 25° C., can be sufficient to provide a polyamide article with a surface modified with sulfonate groups to a significantly high level, e.g. more than 10 percent, say at least 20 percent or more, often about 50 percent, up to about 100 percent sulfonation of amide groups at the surface. For many applications, e.g. metal coatings, it is advantageous to provide articles having the bulk properties of the substrate polyamide with a thin sulfonated surface layer, e.g. less than 50 nanometers thick, e.g. not more than 10 nanometers thick. Longer reaction time, higher concentrations or higher reaction temperature can be used for providing a modified surface layer of greater depth or complete modification of a dissolved polyamide. Solutions of highly sulfonated polyamide can be used to provide films or coatings on a variety of substrates.

Sulfonated polyamide coatings have a variety of advantageous uses. For instance, polyamide textile materials having a sulfonated surface layer have especially durable stainblocking properties as compared to conventional textiles having coatings of sulfonated compounds which can be washed away with successive washings using aggressive detergents. In another application articles having a sulfonated surface layer are useful as precursors for providing metal coatings. In this regard the sulfonate counterion, typically sodium or potassium, can be exchanged with a noble metal such as palladium, e.g in a 1% aqueous solution, to provide a surface which is catalytic to the electroless deposition of metal such as copper or nickel. In many cases the catalytic activity of the palladium sulfonated surface can be significantly enhanced by heating the surface, e.g. in the range of 100° to 200° C. for several minutes.

A metal-coated polyamide article can be provided by immersing the palladium sulfonated polyamide-surfaced article in an electroless deposition bath. The more catalytically active surfaces will provide a bright, uniform metal deposit in a short time, e.g. from 5 to 60 seconds or so. Thicker deposits may require longer metal deposition time. Such metal platings are characterized as having high conductivity (and conversely low resistivity), high abrasion resistance and high adhesion even with multiple exposure to severe environmental conditions, e.g. repeated washings in the case of metal-coated textile articles.

Without intending to be limited thereby, the following examples serve to further illustrate certain aspects of this invention. Polyaramide fabrics used in these examples comprised Kevlar∩ poly (phenyl-diamido terephthalate) fibers and Nomex TM poly (phenyldiamido isophthalate) fibers.

A useful copper bath comprised 1.5 g/1 copper as copper sulfate, 5 g/1 formaldehyde, 0.05 M ethylenediaminetetraacetate (EDTA) maintained at pH 11-12 at 25° C.; a useful nickel bath comprised 4 g/1 nickel 15 g/1 sodium hypophosphite at about pH 7 and 55° C.

The metal-coated fabrics prepared in the following examples were evaluated for the following properties:

Resistivity was determined using a four probe electrode apparatus passing a current between two outer electrodes and determining the resistance in units of ohms/square by measuring the voltage drop between two inner electrodes.

Abrasion Resistance Ratings were determined using an A.A.T.C.C. Crockmeter Model CMl (obtained from Atlas Electric Devices Company, Chicago, Ill.) modified with a 2 kg-loaded reciprocating acrylic finger having a 9.5 mm diameter flat bottomed tip which rubbed for 25 reciprocal cycles on the top of 2 layers of adhesive tape (Highland TM 6200 permanent mending tape from 3-M Company) on the metallized fabric. The amount of metal adhering to the tape after it is pulled from the fabric indicates the abrasion resistance rating:

5-indicates that essentially no metal is removed;

4-indicated that enough metal is removed to provide an outline of the path of the acrylic finger is barely visible;

3-indicates that enough metal is removed so that a distinct outline of the path of the acrylic finger is visible;

2-indicates that so much metal is removed so that rubbed pathway is completely filled in with metal; and 1-indicates that metal is adhered to the tape outside of the area of the pathway.

Launderaility was determined by washing a sample of metal-coated fabric for 10 minutes in 1 liter of water (22° C., hardness 50 ppm calcium carbonate 3/2 Ca/Mg) with 1.86 g ERA brand laundry detergent (from Proctor & Gamble) in a commercial household washing machine, followed by a cold water rinse and spin dry.

Near field shielding was determined by measuring the attenuation of electromagnetic radiation of frequencies in the range of 1 to 100 megaHertz.

EXAMPLE 1

This example illustrates the preparation of benzylsulfonated polyaramide. 0.5 g of Kevlar 41 polyaramide fiber was dissolved in a solution of 0.5 g of potassium t-butoxide, 0.5 g methanol and 10 ml of DMSO producing a viscous solution of 5% deprotonated polyaramide. 0.11 g of sodium 4-bromobenzylsulfonic acid was added to 1.045 g of the deprotonated polyaramide solution providing a low viscosity water-soluble sulfonated polyaramide. The sulfonated polyaramide was soluble in water and methanol but insoluble in acetone. Solutions of benzyl sulfonated polyaramide are useful for providing coatings of sulfonated polyaramide.

EXAMPLE 2

This example illustrates the preparation of sulfonated polyamide fabric which exhibits stain blocking properties.

Woven ripstop fabric of nylon-6,6 fibers was immersed for 5 minutes in a solution of 0.5 g potassium t-butoxide and 0.5 g methanol in 10 ml of DMSO to provide deprotonated amines on the amide nitrogen in the polymer backbone. The deprotonated polymer was immersed in a solution of 0.33 g of sodium 4-bromobenzylsulfonic acid in 3.3. g DMSO (52° C.) to provide a fabric of polyamide fibers having benzylsulfonate groups attached to the surface thereof. The fabric of sulfonated polyamide fibers was washed with deionized (DI) water and dried to provide a fabric having stain blocking properties.

EXAMPLE 3

This example illustrates the use of sulfonated polyamide fabric in providing metal-coated textile materials. Sulfonated polyamide fabrics prepared according to Example 2 were immersed for 5 minutes in a solution of 0.3 g of palladium acetate in a mixture of acetonitrile (24 ml) and water (6 ml) to provide palladium metal as counterions for the sulfonate anions. The palladium containing fabric was washed with DI water and dried by heating for 180° C. for 5 minutes and immersed for about 20 minutes in a Nickel Bath, providing a shiny nickel coating exhibiting resistivity of 0.4 ohms/square, metal adhesion rating of 2, and near field shielding of 54 decibels (dB).

EXAMPLE 4

This example illustrates the preparation of sulfonated polyamide fabric which exhibits stain blocking properties.

Woven fabric of Kevlar polyaramide, fibers was immersed for 5 seconds in a solution of 2.5 g potassium t-butoxide and 2.5 g methanol in 250 ml of DMSO to provide deprotonated polyaramide nitrogen in the polymer backbone. The deprotonated polymer was immersed in a solution of 2.5 g of sodium 4-bromobenzylsulfonic acid in 150 g DMSO at 25° C. to provide a fabric of polyamide fibers having benzylsulfonate groups attached to the surface thereof. The fabric of sulfonated polyamide fibers was washed with deionized (DI) water to provide polyaramide fabric having stain blocking properties.

EXAMPLE 5

This example illustrates the use of sulfonated polyamide fabric in providing metal-coated textile materials. Sulfonated polyamide fabrics prepared according to Example 4 were immersed For 3 minutes in a solution of 1.5 g of palladium acetate in a mixture of acetonitrile (120 ml) and water (30 ml) to provide palladium metal as counterions for the sulfonate anions. The palladium containing fabric was washed with DI water and dried by heating for 165° C. for 10 minutes. A portion of the fabric was immersed for 20 minutes in a Nickel Bath providing a nickel-coated polyaramide fabric having a resistance of 0.4 ohms/square, a metal adhesion rating of 5 and near field shielding of 52 dB. A portion of the fabric was immersed for 20 minutes in a Copper Bath providing a copper-coated polyaramide fabric with 20 weight percent shiny copper coating having a resistance of 0.03 ohms/square, a metal adhesion rating of 4 and near field shielding of 71 dB. Portions of the copper-coated polyaramide fabric were coated with silver in a replacement bath (comprising 1.2 g/1 silver as silver nitrate, 6.13 g/1 ammonia, 0.89 g/1 citric acid and 1.85 g/1 copper as copper nitrate ) and with tin in a replacement bath (comprising 10% methylsulfonic acid, 4 g/1 SnCl2 and 50 g/1 thiourea); the tin coated fabric exhibited near field shielding of 62 dB.

EXAMPLE 6

This example illustrates an alternative preparation of sulfonated polyamide fabric essentially according to the procedure of Example 4 except that the sulfonation was effected using a solution of 2.5 g of 1,3-propylsultone in 250 ml DMSO as the sulfonating agent to provide a fabric of sulfonated polyaramide fibers having stain blocking properties. A portion of the sulfonated fabric was provided with palladium counterions as in Example 5. A portion of the palladium containing fabric was immersed in a Copper Bath providing a copper-coated polyaramide fabric having a resistance of 0.13 ohms/square, a metal adhesion rating of 4 and near field shielding of 64 dB. Another portion of the palladium-containing fabric was immersed in a Nickel Bath providing a nickel-coated polyaramide fabric having a resistance of 0.4 ohms/square, a metal adhesion rating of 5 and near field shielding of 52 dB.

EXAMPLE 7

This example illustrates the sulfonation and metallization of another polyaramide. Nomex TM phenyl- diamido isophthalate polyaramide fabric was sulfonated essentially in the manner of example 4 to provide a stain-resistant sulfonated fabric which was catalyzed and metallized essentially in the manner of example 5. Copper-coated polyaramide fabric exhibited resistance of 0.5 ohms/square and metal adhesion rating of 3; nickel-coated polyaramide fabric exhibited resistance of 0.3 ohms/square and metal adhesion rating of 3.

EXAMPLE 8

This example illustrates the surprising flame resistance of nickel-coated fabrics according to this invention. Fabrics were evaluated for flame resistance by holding a flame to the bottom of a vertical strip of fabric (2 cm wide by 20 cm long). The flame is removed when the fabric ignites. Flame resistance is indicated by the propensity of the burning fabric to extinguish. Although phenyldiamido isophthalate polyaramide fabrics (e.g. Nomex TM polyaramides) are known to be exceptionally flame retardant, when such fabrics are metal coated using catalytic polymeric coatings comprising polyvinylalcohol or nitrile rubber, e.g. as disclosed by Vaughn in U.S. Pat. No. 5,082,734, the metal-coated fabrics are substantially less flame retardant, e.g. with flame retention as long as a minute or so. Copper and Nickel-coated fabric prepared as in example 7 surprisingly exhibited flame retardance essentially the same as uncoated fabric. The flame retardance of a variety of metal-coated fabrics is tabulated in the following Table 1.

TABLE 1

| FABRIC | COATING | METAL | FLAME TIME | GLOW TIME | FABRIC CONSUMED |
|---|---|---|---|---|---|
| KEVLAR(a) | none | none | 3 sec | none | 2 inch |
| KEVLAR(a) | EVA | none | 3 | none | 2 |
| KEVLAR(a) | EVA | copper | 5 | 90 sec | 8 |
| KEVLAR(a) | EVA | nickel | 3 | 1–4 sec | 2 |
| KEVLAR(a) | $SO_3$ | none | 3 | none | 2 |
| KEVLAR(a) | $SO_3$ | nickel | 7 | none | 2 |
| KEVLAR(a) | $SO_3$ | copper | 4–5 | 20–40 | 2–3 |
| KEVLAR(c) | nitrile | Ag/Cu | 3–4 | 15–20 | 2½ |
| KEVLAR(c) | nitrile | nickel | 3 | 1 sec | 2 |
| KEVLAR(d) | EVA | copper | 13 | 3 min | |
| KEVLAR(e) | PVOH | none | 10 | none | 8 |
| KEVLAR(e) | PVOH | copper | 4 | none | 8 |
| NOMEX | none | none | 1 | none | ¼ |
| NOMEX | $SO_3$ | none | 1 | none | ¼ |
| NOMEX | $SO_3$ | nickel | 1 | none | ¼ |
| NOMEX | $SO_3$ | copper | 14 | 25–30 s | 2½ |
| NOMEX(b) | nitrile | Ag/Cu | 1 min | 4¼ min | 8 |
| NYLON-6,6 | $SO_3$ | nickel | 5½ | none | 8 |

(a)1.85 oz/sq yd Kevlar polyaramide; (b)5.5 oz/sq yd
(c)0.82 oz/sq yd; (d)5.3 oz/sq yd; (e)0.33 oz/sq yd

EXAMPLE 9

This example illustrates the superior launderability of metallized fabrics according to this invention. Copper and nickel coated onto sulfonated polyamide fabrics prepared in the manner of examples 2–7 were tested for near field electromagnetic shielding properties before and after laundering. Comparative data was obtained for metal-coated polyamide fabrics prepared using catalytic polymeric coatings, e.g. palladium containing layers of polyvinylalcohol, ethylene vinylacetate copolymer and nitrile rubber, as disclosed by Vaughn in U.S. Pat. No. 5,082,734. The results reported in Table 2 show the superior resistance to laundering conditions exhibited by the metal-coated fabrics prepared in the manner of this invention.

TABLE 2

| | | | SHIELDING | |
|---|---|---|---|---|
| FABRIC | COATING | METAL | INITIAL | AFTER WASH |
| KEVLAR | $SO_3$ | copper | 64 dB | 61 dB |

TABLE 2-continued

| FABRIC | COATING | METAL | SHIELDING INITIAL | SHIELDING AFTER WASH |
|---|---|---|---|---|
| KEVLAR | EVA | copper | 60 dB | 8 dB |
| KEVLAR | nitrile | copper | 65 dB | 39 dB |
| NYLON-6,6 | PVOH | copper | 60 dB | 14 dB |

While specific embodiments have been described, it should be apparent to those skilled in the art that various modifications thereof can be made without departing form the true spirit and scope of the invention. Accordingly, it is intended that the following claims cover all such modifications within the full inventive scope.

What is claimed is:

1. A metal-coated polyamide article having benzylsulfonate or propylsulfonate groups chemically attached to amide nitrogen of the polyamide in a surface layer between the polyamide article and a metal coating.

2. A metal-coated polyamide article according to claim 1 wherein said polyamide is selected from the group consisting of nylon-6, nylon-6,6, nylon-6,6 nylon-11 , nylon 12, a partially aromatic nylon comprising hexamethylene diamido adipate-isophthalate, polyaramide comprising phenyldiamido terephthalate and polyaramide comprising phenyldiamido isophthalate.

3. A metal-coated polyamide article according to claim 2 wherein said metal layer is electrolessly deposited copper or nickel.

4. Polyaramide having benzylsulfonate groups chemically attached to at least 1 percent of the amide groups of said polyaramide.

5. An article comprising a polyamide substrate having sulfonate groups substituted on amide nitrogen at the surface thereof wherein substantially all of said sulfonate groups are within 1 micrometer from said surface.

6. An article according to claim 5 wherein said groups are within 10 nanometers of said surface.

7. An article according to claim 5 wherein said sulfonate groups are selected from the group consisting of benzylsulfonate and propylsulfonate.

8. An article according to claim 7 wherein said polyamide is derived from a amine selected from the group consisting of hexamethylene diamine and phenyl diamine and at least one acid selected from the group consisting of terephthalic acid, isophthalic acid and adipic acid.

9. An article according to claim 7 wherein said polyamide is selected from the group consisting of nylon-6, nylon-6,6, nylon-11, nylon 12, a partially aromatic nylon comprising hexamethylene diamido adipate-isophthalate, polyaramide comprising phenyldiamido terephthalate and polyaramide comprising phenyldiamido isophthalate.

10. A stain-resistant textile article comprising polyamide fibers having sulfonate groups chemically attached to amidenitrogen at the surface.

11. A stain-resistant polyamide textile article according to claim 10 wherein said sulfonate groups are selected from the group consisting of benzylsulfonate and propylsulfonate.

12. A stain-resistant polyamide textile article according to claim 10 wherein said polyamide is selected from the group consisting of nylon-6, nylon-6,6, nylon-11, nylon 12, a partially aromatic nylon comprising hexamethylene diamido adipate-isophthalate, polyaramide comprising phenyldiamido terephthalate and polyaramide comprising phenyldiamido isophthalate.

13. A method chemically attaching sulfonate groups to amide nitrogen of polyamide comprising:

(a) wetting said polyamide in a solvent comprising dimethylsulfoxide or a butoxide salt, and (b) then wetting the polyamide with a solution comprising bromobenzylsulfonate or propylsultone.

* * * * *